US009672683B2

(12) United States Patent
Matsushita et al.

(10) Patent No.: US 9,672,683 B2
(45) Date of Patent: Jun. 6, 2017

(54) DRIVE CONTROL DEVICE AND DRIVE CONTROL SYSTEM

(71) Applicant: OMRON Corporation, Kyoto-Shi (JP)

(72) Inventors: Katsumi Matsushita, Hashima (JP); Hiroyuki Ibuki, Ichinomiya (JP); Yasuyuki Ohba, Ichinomiya (JP)

(73) Assignee: OMRON CORPORATION, Kyoto-shi (JP)

( * ) Notice: Subject to any disclaimer, the term of this patent is extended or adjusted under 35 U.S.C. 154(b) by 511 days.

(21) Appl. No.: 14/286,546

(22) Filed: May 23, 2014

(65) Prior Publication Data

US 2014/0364213 A1 Dec. 11, 2014

(30) Foreign Application Priority Data

Jun. 6, 2013 (JP) ..... 2013-120131

(51) Int. Cl.
*A63F 9/24* (2006.01)
*G07F 17/32* (2006.01)

(52) U.S. Cl.
CPC ..... *G07F 17/3213* (2013.01)

(58) Field of Classification Search
CPC ..... G07F 17/3213; G05B 2219/21037
See application file for complete search history.

(56) References Cited

U.S. PATENT DOCUMENTS 4,682,168 A * 7/1987 Chang ..... G08C 15/12 340/10.3
5,553,070 A * 9/1996 Riley ..... G05B 19/042 327/365

(Continued)

FOREIGN PATENT DOCUMENTS

JP 2002-163713 A 6/2002
JP 2004-180417 A 6/2004

(Continued)

OTHER PUBLICATIONS

Australian Office Action issued Nov. 4, 2015 in AU Application No. 2014202759.

(Continued)

*Primary Examiner* — Dmitry Suhol
*Assistant Examiner* — Carl V Larsen
(74) *Attorney, Agent, or Firm* — Nutter McClennen & Fish LLP; John J. Penny, Jr.

(57) ABSTRACT

A drive control system has: a plurality of drive control devices; and an upper-level control device to which each of the drive control devices is connected in parallel with each other via a common signal line. The upper-level control device transmits a common information acquirement request signal to each of the drive control devices. Upon receiving the information acquirement request signal, each of the drive control devices determines transmission start timing for a response signal based on transmission sequence information indicating its transmission sequence and a length of the response signal such that the response signal does not temporally overlap with a response signal being transmitted from another drive control device to the upper-level control device. Each of the drive control devices transmits the response signal to the upper-level control device via the signal line at its transmission starting timing.

8 Claims, 8 Drawing Sheets

(56) References Cited

U.S. PATENT DOCUMENTS

| | | | | |
|---|---|---|---|---|
| 6,230,078 | B1 * | 5/2001 | Ruff | G05B 19/0426 700/247 |
| 2005/0054422 | A1 * | 3/2005 | Rothkranz | G07F 17/3211 463/20 |
| 2008/0004102 | A1 * | 1/2008 | Kojima | G07F 17/3202 463/20 |

FOREIGN PATENT DOCUMENTS

| | | | |
|---|---|---|---|
| JP | 2009-247833 | A | 10/2009 |
| JP | 2012-024238 | A | 2/2012 |
| JP | 2012-139538 | A | 7/2012 |

OTHER PUBLICATIONS

Japanese Office Action for Application No. JP 2013-120131, issued Dec. 20, 2016 (11 pages).

* cited by examiner

| Operation | TR1 | TR2 | TR3 | TR4 |
|---|---|---|---|---|
| Forward rotation, Drive | ON | OFF | OFF | ON |
| Forward rotation, Stop | OFF | OFF | OFF | OFF |
| Backward rotation, Drive | OFF | ON | ON | OFF |
| Backward rotation, Stop | OFF | OFF | OFF | OFF |
| Brake | OFF | OFF | ON | ON |

400

DRIVE CONTROL DEVICE AND DRIVE CONTROL SYSTEM

CROSS REFERENCE TO RELATED APPLICATIONS

This application claims the benefit of priority from Japanese Patent Application No. 2013-120131, filed Jun. 6, 2013, the entire contents of which is incorporated herein by reference for all purposes.

BACKGROUND

The present invention relates to a drive control device and a drive control system which control a drive device for driving a movable body provided in a game machine.

A game machine, such as a reel game machine or a pinball game machine, has been devised for executing a performance that appeals to the player's sense of vision, sense of hearing or feeling. Especially, in order to execute a performance that appeals to the player's sense of vision, a movable body whose position or shape is variable, such as a movable accessory, may be provided in the game machine. Such a movable body is driven by a drive device such as a stepping motor. Then, a processor unit for performance (hereinafter simply referred to as performance CPU) as one example of an upper-level control device transmits, to a control circuit of the stepping motor, a command to rotate the stepping motor based on the number of steps corresponding to a movement amount of the movable body that moves to a designated position in accordance with a state of a game.

Further, in recent years, there has been an increase in the number of controllable objects, configured to be controlled by the performance CPU, installed in the game machine so as to enhance the player's interest. For example, the game machine is installed with controllable objects such as a large number of light sources and a display device such as a liquid crystal display other than a plurality of movable accessories. For this reason, the game machine is also installed with a plurality of drive control circuits each of which controls the drive device for the movable body (e.g., see Unexamined Japanese Patent Publication No. 2012-139538 and Unexamined Japanese Patent Publication No. 2012-24238).

Moreover, there has been proposed a movable body drive device which transmits an operation result of the movable body to the upper-level control device and drives the movable body by a drive unit based on a command from the control device or the operation result, so as to accurately move the movable body to a desired position (e.g., see Unexamined Japanese Patent Publication No. 2009-247833).

In order for the performance CPU to accurately move each movable body or grasp abnormality having occurred in each movable body, the performance CPU needs to acquire, from each drive control device, information concerning a state of each movable body controlled by the drive control device, as described in Unexamined Japanese Patent Publication No. 2009-247833. However, since the number of terminals of the performance CPU is limited, each drive control device may be connected in parallel with each other to the performance CPU. Accordingly, in order to avoid collision of a signal from each drive control device to the performance CPU, the performance CPU individually outputs an information acquirement request signal to each drive control device in accordance with a polling system, for example. The drive control device having received the information acquirement request signal outputs a response signal including necessary information to the performance CPU. Therefore, for acquiring information from all the drive control devices, the performance CPU has been required to repeat transmission of the information acquirement request signal and reception of the response signal just the number of times being the number of drive control devices. As a result, the more the number of drive control devices installed in the game machine increases, the longer the cycle required for acquiring information on each drive control device. This might make it difficult for the performance CPU to control such a movable body as required to have real-time characteristics. Further, with the information acquirement cycle becoming longer, when abnormality occurs in a drive device such as a motor for driving the movable body, the timing for making an abnormality detection report from the drive control device that controls the drive device to the performance CPU might be delayed to increase the risk of breakdown and the like.

SUMMARY

In an embodiment, there is a drive control system comprising:

a plurality of drive control devices configured to individually control a plurality of drive devices for driving a movable body provided in a game machine; and an upper-level control device to which the plurality of drive control devices are connected in parallel with each other via a common signal line.

The upper-level control device is configured to transmit a common information acquirement request signal to each of the plurality of drive control devices.

Each of the plurality of drive control devices is configured to:

receive the common information acquirement request signal;

determine a transmission start timing for a response signal based on its transmission sequence information indicating its transmission sequence and a length of the response signal such that the response signal does not temporally overlap with a response signal to be transmitted from another one of the plurality of the drive control devices to the upper-level control device, and transmit the response signal to the upper-level control device via the signal line at its transmission start timing upon receiving a trigger signal from the upper-level control device.

DETAILED DESCRIPTION

Hereinafter, a drive control device according to one embodiment will be described with reference to the drawings. In a drive control system where a plurality of drive control devices are connected in parallel with each other to a performance CPU as one example of an upper-level control device, the performance CPU outputs a common information acquirement request signal (hereinafter referred to as an information acquirement request signal or an information acquirement request command) to each of the plurality of drive control devices, and then outputs a trigger signal to each of the plurality of drive control devices. The trigger signal may be an enable signal serving as a trigger to each drive control device for determining a timing for transmitting a response signal to the information acquirement request signal from each drive control device to the performance CPU.

Upon receiving the information acquirement request signal, each drive control device decides or determines a time from receiving the trigger signal to itself starting output of a response signal such that the response signal from each drive control device does not temporally overlap and the response signal of each drive control device is outputted with an interval therebetween being shorter than the information acquirement request signal.

Then, after the lapse of the time from receiving the trigger signal to itself starting transmission of the response signal, each drive control device starts transmission of the response signal. A response signal may include predetermined information of each drive control device. The predetermined information may include information indicating a state of a drive device or information indicating a state of the movable body driven by the drive device. Therefore, the performance CPU can obtain necessary information from each drive control device by transmitting the information acquirement request signal to each of all the drive control devices just once.

The drive control device may be capable of reducing a cycle for transmitting information to an upper-level control device even when a plurality of drive control devices are connected in parallel with each other to the upper-level control device, and provide a drive control system having such a drive control device.

Figure 1:
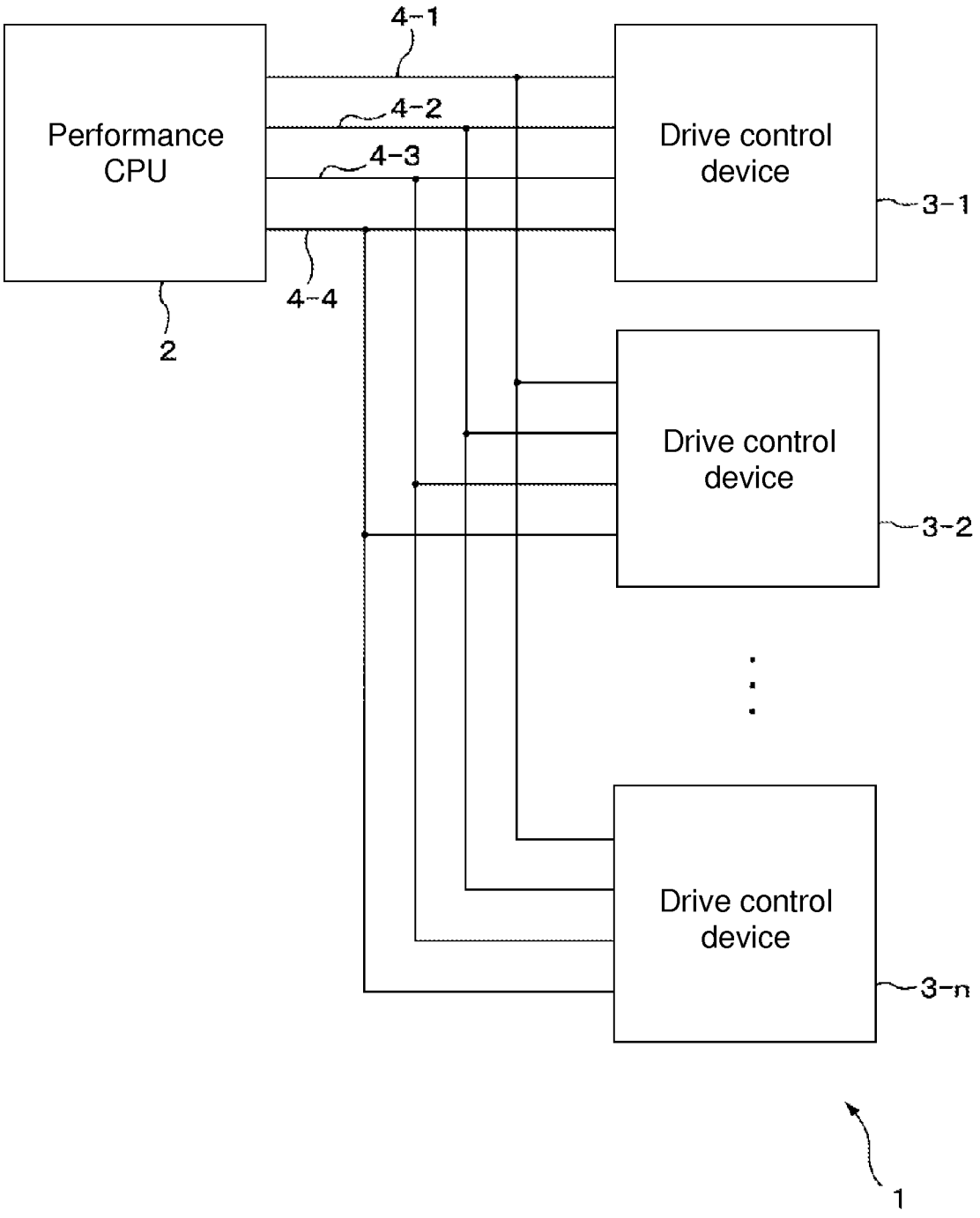
FIG. 1 is a schematic block diagram of a drive control system including a plurality of drive control devices according to one embodiment.

FIG. 1 is a schematic block diagram of a drive control system including a plurality of drive control devices according to one embodiment. A drive control system 1 includes a performance CPU 2 and n (n is an integer not smaller than 2) drive control devices 3-1 to 3-n. Based on a drive command received from the performance CPU 2, each drive control device controls a drive device, such as a stepping motor, a DC motor or a solenoid, which drives a movable body such as a movable accessory provided in a game machine. Hence each drive control device is connected in parallel with each other to the performance CPU 2 via four signal lines 4-1 to 4-4.

The signal line 4-1 is used for transmitting a command from the performance CPU 2 to each drive control device. Further, the signal line 4-2 is used for supplying a clock signal from the performance CPU 2 to each drive control device. Moreover, the signal line 4-3 is used for transmitting a signal to be transmitted from each drive control device to the performance CPU 2. Then, the signal line 4-4 is used for transmitting an enable signal from the performance CPU 2 to each drive control device, the enable signal serving as a trigger for deciding timing for transmission of the response signal to the information acquirement request signal from each drive control device to the performance CPU 2.

Further, a unique address is set to each drive control device. The address is one example of a transmission sequence information which is used for deciding transmission timing for the response signal. In an embodiment, addresses 0 to (n−1) are respectively set to drive control devices 3-1 to 3-n.

Next, a detail of the drive control device will be described in FIG. 2. Since each drive control device has the same configuration and the same function concerning communication with the performance CPU, a drive control device 3-1 will be described as a representative of each drive control device.

Figure 2:
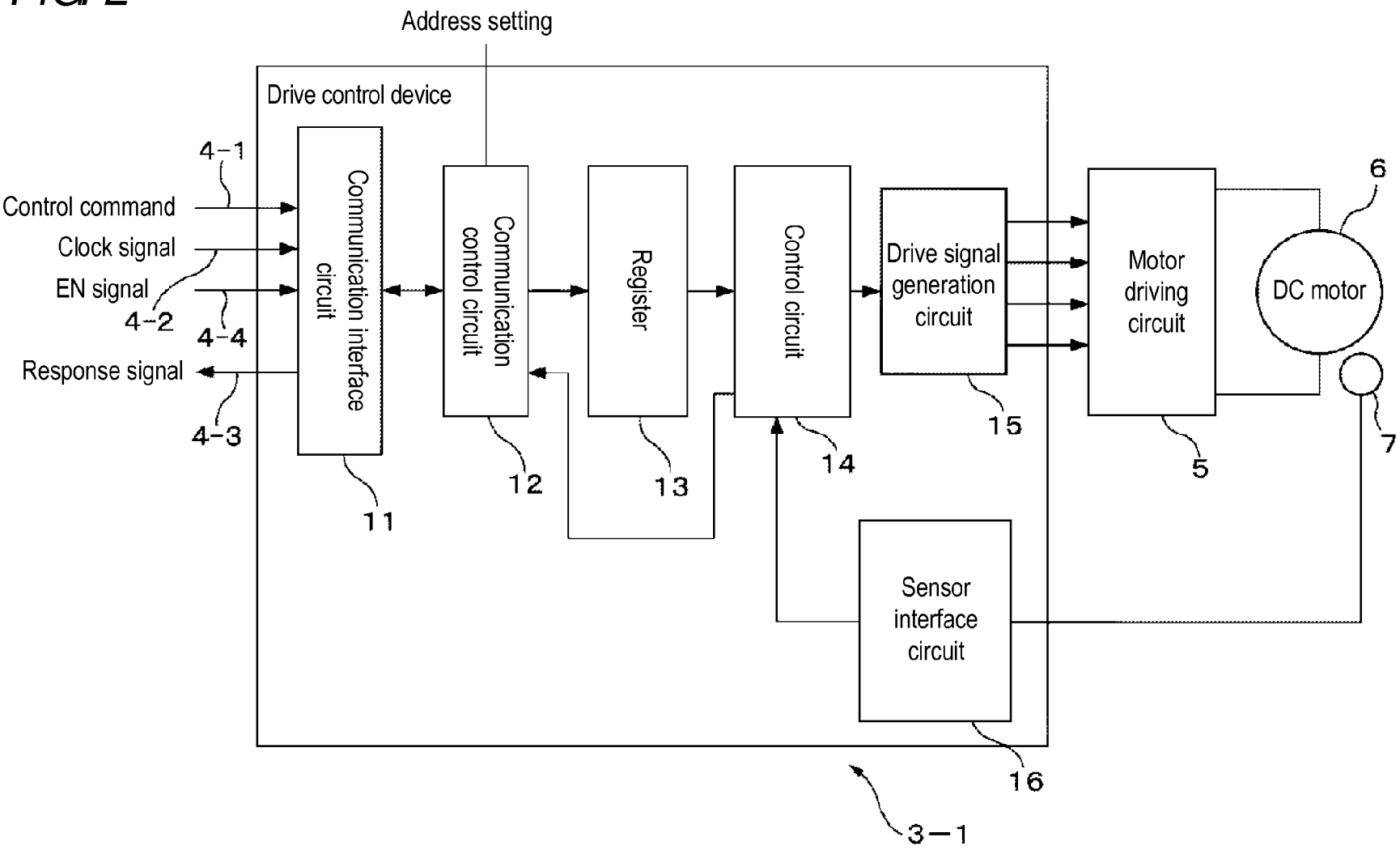
FIG. 2 is a schematic block diagram of the drive control device according to one embodiment.

FIG. 2 is a schematic constitutional diagram of a drive control device 3-1 according to one embodiment. As shown in FIG. 2, the drive control device 3-1 has a communication interface circuit 11, a communication control circuit 12, a register 13, a control circuit 14, a drive signal generation circuit 15, and a sensor interface circuit 16.

Each of the above parts provided in the drive control device 3-1 may be mounted on a circuit substrate (not shown) as a separate circuit, or may be mounted on the circuit substrate as an integrated circuit where each of the above parts is integrated.

The drive control device 3-1 outputs a pulse-like drive signal to the motor driving circuit 5 that supplies a current to the (DC) motor 6 as a controlled object. The pulse-like drive signal switches on-off of the current supply to an arbitrary coil or the like of the DC motor 6, according to a control command received from the performance CPU, thereby to control the DC motor 6. It is to be noted that the drive device controlled by the drive control device 3-1 is not restricted to the DC motor 6, but the drive device may include the stepper motor or the solenoid. Also in this case, the drive signal generation circuit 15 may only generate a drive signal in accordance with the drive device as the controlled object, and output a drive signal to a circuit for supplying electric power to the drive device.

The drive control device 3-1 controls the current supply to the DC motor 6 by a pulse width modulation (PWM) system, so as to rotate the DC motor 6 at a target rotational speed designated by the control command. Therefore, the drive control device 3-1 changes a pulse width per cycle of the drive signal in accordance with the target rotational speed.

Further, in order to rotate the DC motor 6 just in a target rotation amount, every time a rotational shaft (not shown) of the DC motor 6 is rotated at a predetermined angle, the drive control device 3-1 receives from the rotary encoder 7 a detection signal showing that the rotational shaft has been rotated at the predetermined angle, and calculates a total rotational amount from the start of rotation. The drive control device 3-1 then appropriately decelerates the DC motor 6 in accordance with a difference between the target rotation amount designated by the control command and the total rotation amount. Hence the drive control device 3-1 stops the DC motor 6 when the DC motor 6 rotates just in the target rotation amount, namely after the movable body driven by the DC motor 6 is moved just a predetermined distance.

Figures 3, 4:
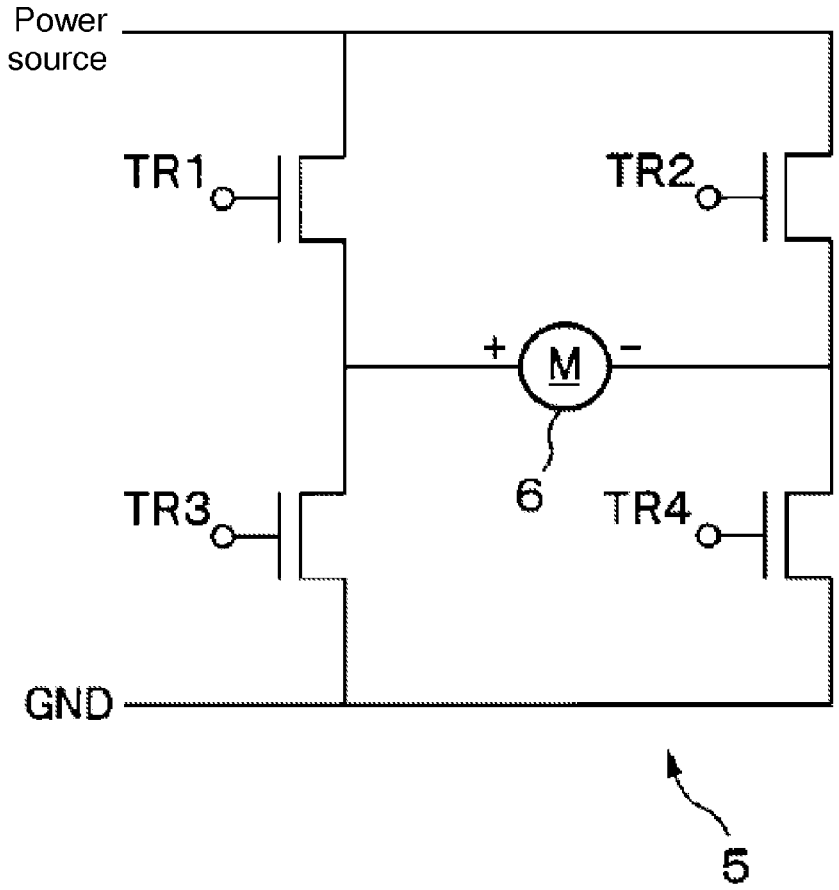
FIG. 3 is a circuit diagram of a motor driving circuit.
FIG. 4 is a diagram showing one example of a table indicating the relation between a drive signal that is applied to each switch of the motor driving circuit and a rotational direction of a DC motor.

FIG. 3 is a circuit diagram of the motor driving circuit 5. The motor driving circuit 5 has four switches TR1 to TR4. It is to be noted that each switch can, for example, be a transistor or a field effect transistor. Among them, two switches TR1 and TR3 are connected in series between a power source and a ground. Similarly, two switches TR2 and TR4 are connected in series between the power source and the ground. A positive-electrode-side terminal of the DC motor 6 is connected between switch TR1 and switch TR3, whereas a negative-electrode-side terminal of the DC motor 6 is connected between switch TR2 and switch TR4. A switch terminal of each of switches TR1 to TR4 (e.g., it corresponds to a base terminal when each of switches TR1 to TR4 is the transistor, and it corresponds to a gate terminal when each of switches TR1 to TR4 is the field effect transistor) is connected to the drive signal generation circuit 15. The drive signal from the drive signal generation circuit 15 is then inputted into the switch terminal of each of switches TR1 to TR4.

FIG. 4 is a diagram showing one example of a table indicating the relation between the drive signal that is applied to each switch of the motor driving circuit 5 and the rotational direction of the DC motor 6.

As shown in table 400, in the case of rotating the DC motor 6 forward, a drive signal is applied to the switch terminal of switch TR1 and the switch terminal of switch TR4, the drive signal having been set according to the PWM system and including a cyclic pulse with a pulse width in accordance with the rotational speed of the DC motor 6. On the other hand, the drive signal is not applied to the switch terminal of switch TR2 and the switch terminal of switch TR3. Accordingly, since a power supply voltage is applied to the positive-electrode-side terminal in the DC motor 6 only during application of pulses to switch TR1 and switch TR4, the DC motor 6 is rotated forward at a speed in accordance with the pulse width.

It is to be noted that in the case of rotating the DC motor 6 forward, the drive signal may be applied to one of switch TR1 and switch TR4, and the other may be constantly turned on.

On the other hand, in the case of rotating the DC motor 6 backward, a drive signal is applied to the switch terminal of switch TR2 and the switch terminal of switch TR3, the drive signal having been set according to the PWM system and having a cyclic pulse in accordance with the rotational speed of the DC motor 6. On the other hand, the drive signal is not applied to the switch terminal of switch TR1 and the switch terminal of switch TR4. Accordingly, since a power supply voltage is applied to the negative-electrode-side terminal in the DC motor 6 only during application of pulses to switch TR2 and switch TR3, the DC motor 6 is rotated backward at a speed in accordance with the pulse width.

It is to be noted that in the case of rotating the DC motor 6 backward, the drive signal may be applied to one of switch TR2 and switch TR3, and the other may be constantly turned on.

Further, in the case of applying a brake to the DC motor 6, the switch terminal of switch TR3 and the switch terminal of switch TR4 are turned on, and the switch terminal of switch TR1 and the switch terminal of switch TR2 are turned off.

Further, in the case of not driving the DC motor 6, the switch terminal of each switch is turned off.

The rotary encoder 7 is one example of a rotational angle sensor, and for example, it can be an optical rotary encoder. The rotary encoder 7, for example, has: a disk fitted to the rotational shaft of the DC motor 6 as the controlled object and having a plurality of slits along a circumferential direction centered with the rotational shaft; and a light source and a light receiving element which are arranged so as to be opposed to each other with the disk placed therebetween. Then, every time any of the slits is located between the light source and the light receiving element, light from the light source reaches the light receiving element, and the rotary encoder 7 thereby outputs a pulse-like detection signal. Accordingly, the rotary encoder 7 outputs the detection signal every time the DC motor 6 is rotated at a predetermined angle. For example, 50 slits are provided in the disk along the circumferential direction centered with the rotational shaft of the DC motor 6, and the rotary encoder 7 thereby outputs 50 detection signals while the rotational shaft of the DC motor 6 makes one rotation. It should be noted that, when the drive device as the controlled object is the stepping motor, the rotary encoder 7 may be omitted.

The communication interface circuit 11, for example, connects the drive control device 3-1 to the performance CPU 2 of the game machine. The communication interface circuit 11 then receives from the performance CPU 2 a control command having a plurality of bits serially transmitted via the signal line 4-1. Further, for analyzing the control command, the communication interface circuit 11 receives a clock signal for making synchronization with each of the plurality of bits included in the control command from the performance CPU 2 via the signal line 4-2. The communication interface circuit 11 then outputs the control command and the clock signal to the communication control circuit 12. Further, the communication interface circuit 11 outputs a response signal, received from the communication control circuit 12 and to be transmitted to the performance CPU 2, to the signal line 4-3. Furthermore, the communication interface circuit 11 receives an enable signal, which is one example of the trigger signal used for determining a timing for transmission of the response signal from the performance CPU 2 via the signal line 4-4.

The clock signal can, for example, be a signal having a rectangular pulse with respect to each predetermined number of bits in the control command. Further, the enable signal is, for example, a signal with a voltage indicating to be off until the start of transmission of the response signal, which is then changed to a voltage indicating to be on at timing for starting transmission of the response signal. Then, for example when the performance CPU 2 receives the response signals from all the drive control circuits, the enable signal is again turned off.

The control command includes: a drive command to specify an operation of the DC motor 6 as the controlled object; and an information acquirement request command to make a request to each drive control device for transmitting, to the performance CPU 2, a response signal including predetermined information such as information indicating a state of the DC motor 6 or information indicating a state of the movable body driven by the DC motor 6.

The drive command, for example, includes operation information for specifying the operation of the DC motor 6, such as a target rotation amount of the DC motor 6 which specifies one operation of the DC motor 6 as the controlled object and corresponds to a movement amount of the movable body that is driven by the DC motor 6, and a rotational speed which corresponds to a moving speed of the movable body. In the meantime, the information acquirement request command, for example, includes a flag indicating the kind of information which the performance CPU 2 wants to acquire, and the like.

Figure 5:
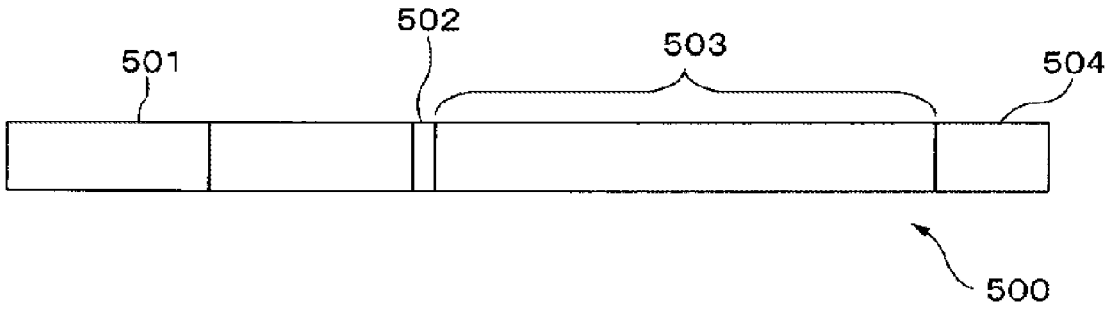
FIG. 5 is a diagram showing one example of a format of an information acquirement request command.

FIG. 5 is a diagram showing one example of a format of the information acquirement request command. As shown in FIG. 5, an information acquirement request command 500 has a START flag 501, a mode flag 502, a command data 503 and an END flag 504, sequentially from the head. Further, the information acquirement request command 500 may, for example, include a one-bit spacer having a value of '0' in each space between the adjacent flag and data.

The START flag 501 is a bit stream indicating to be the head of the information acquirement request command 500, and in an embodiment, it is a bit stream of nine continuous bits each having a value of '1'. It should be noted that the START flag 501 may only be a bit stream not agreeing with any other arbitrary bit stream within the information acquirement request command 500.

The mode flag 502 is one example of response signal length information, and a one-bit flag designating a response mode from the drive control device to the performance CPU. In an embodiment, when the mode flag 502 is '0' indicating a simple mode, the drive control device, for example, creates a response signal including only a rotation amount of the DC motor 6 from the start time point of the drive command having been executed immediately before. On the other hand, when the mode flag 502 is '1' indicating a detail mode, the drive control device, for example, creates a response signal including not only the rotation amount of the DC motor 6 from the start time point of the drive command having been executed immediately before but also internal status information of the drive control device.

It is to be noted that a length of the response signal may vary depending on the response mode. For example, information included in the response signal in the case of the detail mode is larger in amount than information included in the response signal in the case of the simple mode. Hence the response signal in the case of the detail mode may be longer than the response signal in the case of the simple mode.

Further, three or more kinds of response modes may be prepared. In this case, the mode flag 502 may only have a bit number in accordance with the number of response modes.

The command data 503 is a bit stream indicating that the kind of the control command is the information acquirement request command.

The END flag 504 is a bit stream indicating to be the tail of the information acquirement request command 500. The END flag 504 may only be a bit stream not agreeing with the START flag and the other bit streams included in the information acquirement request command.

In addition, it is preferable that the START flag and the END flag included in the information acquirement request command are included in the same position of the drive command. For a similar reason, it is preferable that the length of the drive command is made the same as the length of the information acquirement request command so as to facilitate creation and analysis of the command by the performance CPU 2 and each drive control circuit. Hence the drive command and the information acquirement request command each have a length required for specifying one operation of the DC motor 6, such as a length of 64 bits to 128 bits. As opposed to this, the response signal may, for example, transmit only specific information to the performance CPU 2. Hence the response signal is shorter than the drive command and the information acquirement request command, and for example, it has a length of 16 bits to 48 bits. In an embodiment, when the information acquirement request signal includes an address that specifies any of the plurality of drive control devices, only one of the plurality of drive control devices having an address corresponding to the address transmits the response signal to the upper-level control device. However, when the common information acquirement request signal does not include the address that specifies any of the plurality of drive control devices, each of the plurality of drive control devices transmits the response signal to the upper-level control device in accordance with its transmission start timing.

When the control command received via the communication interface circuit 11 is the drive command, the communication control circuit 12 determines whether or not the drive command is addressed to itself. When the drive command is addressed to itself, the communication control circuit 12 writes operation information and the like, included in the drive command, into the register 13. On the other hand, when the drive command is not addressed to itself, the communication control circuit 12 discards the received drive command.

In order to determine whether or not the drive command is addressed to itself, the communication control circuit 12 determines whether or not a device address included in the drive command agrees with the address set to the drive control device 3-1. When the device address agrees with the set address, the communication control circuit 12 determines that the drive command is addressed to itself.

It should be noted that the address set to the drive control device 3-1 may, for example, be previously written into a nonvolatile memory in the communication control circuit 12. Alternatively, the communication control circuit 12 may have a plurality of address terminals for address setting. In this case, each address terminal corresponds to each digit of binary digits, and a value of a digit corresponding to an address terminal being grounded is set as '0', and a value of a digit corresponding to an address terminal not being grounded is '1'. Accordingly, by changing a combination of the grounded address terminal with respect to each drive control device connected to the performance CPU 2, a unique address is set to each drive control device.

In the meantime, upon reception of the information acquirement request command from the performance CPU 2, the communication control circuit 12 acquires necessary information in accordance with the mode flag included in the information acquirement request command from the control circuit 14 or the register 13. The communication control circuit 12 then creates a response signal in accordance with the mode flag.

Further, based on its address as one example of the transmission sequence information, the communication control circuit 12 determines a transmission start timing for the response signal such that the response signal being transmitted from itself does not temporally overlap with the response signal being transmitted from another drive control device connected with performance CPU 2.

In an embodiment, the communication control circuit 12 determines the transmission start timing for the response signal according to Expression (1):

$$T(A)=D+A*(M+G) \quad \text{Expression (1)}$$

Here, D is a clock number corresponding to delay time from a certain reference time as a time when the enable signal is turned on until the start of first transmission of the response signal by the first drive control device, and for example, it is set to 0 to 32. A is an address uniquely set to each drive control device, and for example, it is set to any integer of 0 to (n−1).

Further, M is a clock number corresponding to the length of the response signal. When the length of the response signal varies depending on whether the response mode is the simple mode or the detail mode, the communication control circuit 12 determines a value of M for example by referencing a table. The table is stored in the nonvolatile memory in the communication control circuit 12 and indicates the relation between the kind of the response mode and the length of the response signal.

G is a clock number corresponding to the interval between the response signals, and for example, it is set to any of 0 to (L−1). It should be noted that L is a clock number corresponding to a length of the information acquirement request command.

Figure 6:
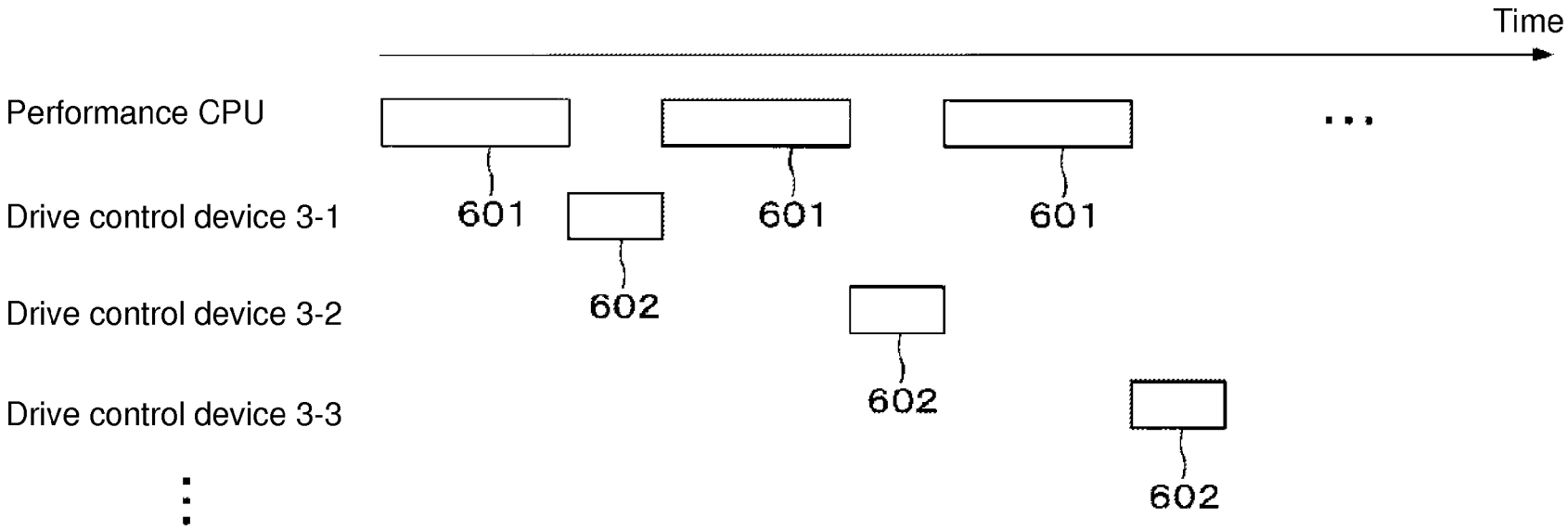
FIG. 6 is a sequence diagram of the case of individually making a request of each drive control device for acquiring information by a polling system, as a comparative example.

FIG. 6 is a sequence diagram of the case of individually making a request of each drive control device for acquiring information by a polling system, as a comparative example. Especially when the performance CPU or the drive control device cannot simultaneously perform transmission and reception of a signal, the performance CPU 2 collects information from each drive control device according to this sequence. In FIG. 6, a horizontal axis indicates time. In this example, time 601 required for transmission of the information acquirement request command and time 602 required for transmission of the response signal are repeated the same number of times as the number of drive control devices connected to the performance CPU 2.

Figure 7:
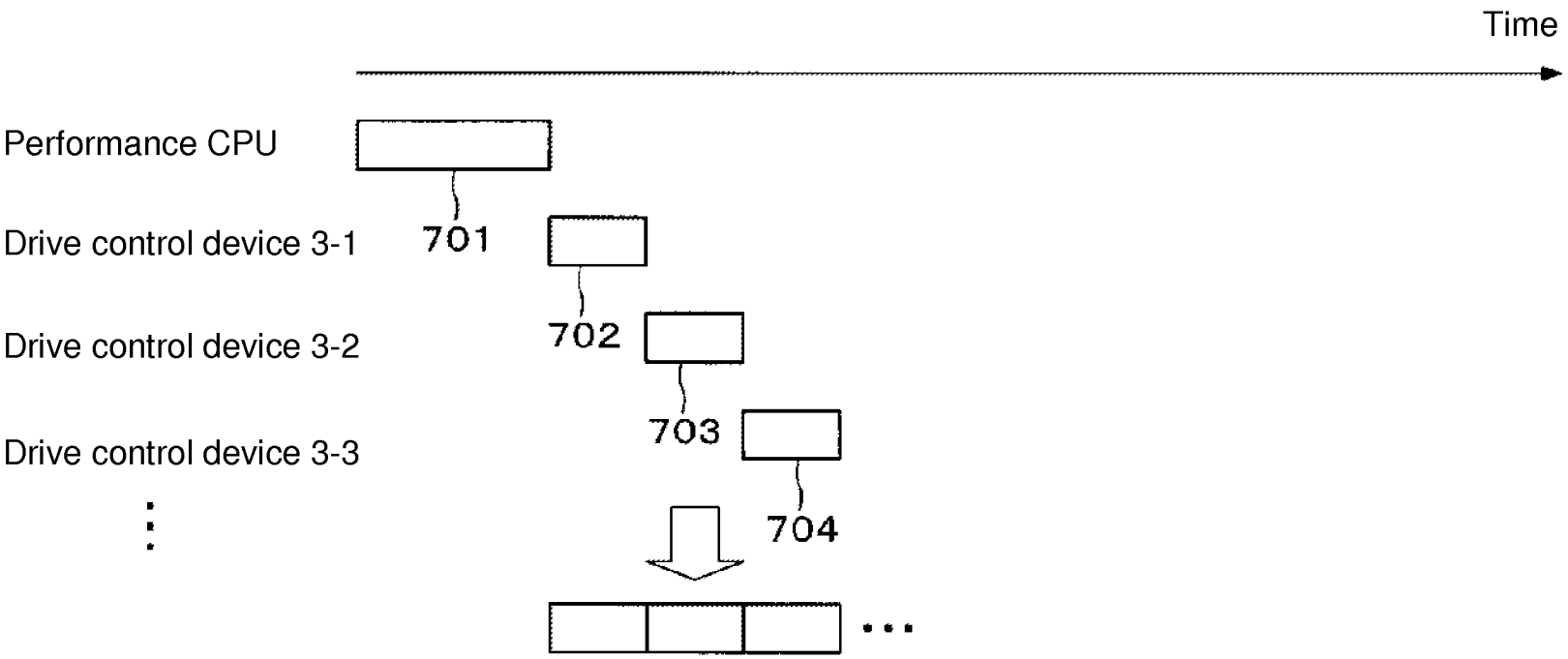
FIG. 7 is a sequence diagram in the case of performance CPU 2 making a request for acquiring information en bloc in drive control system 1 according to an embodiment.

On the other hand, FIG. 7 is a sequence diagram in the case of the performance CPU 2 making a request for acquiring information en bloc in the drive control system 1 according to an embodiment. In FIG. 7, a horizontal axis indicates time. It is to be noted that FIG. 7 corresponds to a case where the transmission start timing is decided as G=0 in Expression (1). In an embodiment, since the performance CPU 2 transmits the common information acquirement request command to each of all the drive control devices, time 701 required for transmission of the information acquirement request command can be just once. Then, each of time 702 to 704 required for transmission of the response signal from the respective drive control devices lags by time corresponding to the length of the response signal. Hence the performance CPU 2 receives one signal formed by connection of the response signals from the respective drive control devices. Therefore, in an embodiment, the time required for receiving the response signals from all the drive control devices is reduced from the time in the case shown in FIG. 6 by time obtained by multiplying a value, obtained by subtracting 1 from the number of drive control devices, by the length of the information acquirement request command.

It should be noted that, when the performance CPU and each drive control device can simultaneously perform transmission and reception of a signal, while the performance CPU receives the response signal from some drive control device via one signal line, it can transmit the information acquirement request command to the next drive control device via another signal line. However, also this time, when the information acquirement request command is longer than the response signal, the time required for each drive control device to transmit the information acquirement request command takes longer as described above. Hence, by following the sequence shown in FIG. 7, the time required for the performance CPU to receive the response signals from all the drive control devices can be shorter.

The communication control circuit 12 starts time counting from the reference time when the enable signal is turned on, and at the transmission start timing, it transmits the response signal to the performance CPU 2 via the communication interface circuit 11.

The register 13 has a memory circuit in what is called a first-in first-out (FIFO) system. The memory circuit has a storage capacity capable of storing at least one piece of operation information. The memory circuit in the register 13 is, for example, made up of a volatile readable/writable semiconductor memory circuit.

The register 13 stores the operation information written by the communication control circuit 12. When the operation information is read by the control circuit 14, the register 13 deletes the operation information.

The control circuit 14, for example, has a processor and a nonvolatile memory circuit. With reference to operation information read from the register 13, the control circuit 14 determines a duty ratio of the drive signal based on a target rotational speed designated in the operation information. Then, the control circuit 14 notifies the drive signal generation circuit 15 of the rotational direction designated in the operation information and the duty ratio.

Furthermore, every time the control circuit 14 executes a command, it counts the number of detection signals received from the rotary encoder 7 after the DC motor 6 starts rotation by execution of the command, and takes a total number of received detection signals as a total rotation amount of the DC motor 6. The control circuit 14 then stores the total rotation amount into the memory circuit.

Every time the control circuit 14 updates the total rotation amount of the DC motor 6, it calculates the difference between the total rotation amount and the target rotation amount designated in rotation amount data included in the command, as a remaining rotation amount. When the remaining rotation amount becomes small, the control circuit 14 makes the duty ratio of the drive signal smaller than the duty ratio corresponding to the target rotational speed. At the time point when the DC motor 6 is rotated just in the target rotation amount designated by the drive command, the control circuit 14 designates the drive signal generation circuit 15 to stop the DC motor 6.

The drive signal generation circuit 15, for example, has: a variable pulse generation circuit capable of changing a pulse width to be outputted; and a switch circuit for switching between the switches of the motor driving circuit 5 to which a cyclic pulse signal is to be outputted,. The pulse signal may be generated by the variable pulse generation circuit and may be a drive signal. The drive signal generation circuit 15 then generates a drive signal for driving the DC motor 6 in accordance with the duty ratio notified from the control circuit 14 according to the PWM system, and outputs the drive signal to any of the switches of the motor driving circuit 5. It is to be noted that a length of one period of the drive signal is, for example, 50 μsec. For example, when the rotational direction notified from the control circuit 14 is forward rotation, the drive signal generation circuit 15 outputs the cyclic pulse signal to switches TR1 and TR4 of the motor driving circuit 5. On the other hand, when the rotational direction notified from the control circuit 14 is backward rotation, the drive signal generation circuit 15 outputs the cyclic pulse signal to switches TR2 and TR3 of the motor driving circuit 5.

The sensor interface circuit 16 has an interface circuit that receives a detection signal from the rotary encoder 7. Every time the sensor interface circuit 16 receives a detection signal, it outputs the detection signal to the control circuit 14.

As described above, the performance CPU as the upper-level control device transmits the common information acquirement request command only once to each of the plurality of drive control devices connected in parallel with each other. Thereby, each drive control device determines the transmission start timing for the response signal such that the response signals does not temporally overlap with each other, and starts transmission of the response signal at the transmission start timing. This eliminates the need for the upper-level control device to transmit the information acquirement request command to each drive control device, thereby to allow reduction in time required for reception of the response signal from each drive control device.

According to a modified example, each drive control device may determine the transmission start timing for the response signal the transmission sequence information of the response signal of each drive control device instead of the address, wherein each drive control device is connected in parallel with each other to the upper-level control device, the transmission sequence information being uniquely set to each drive control device. The transmission sequence information may, for example, be previously stored in the non-volatile memory of the communication control circuit in each drive control device, separately from the address. Alternatively, at the start-up of the game machine, the upper-level control device may transmit to each drive control device a transmission sequence setting command including a transmission sequence of the address and the response signal of the drive control device. The drive control device may store into the memory of the communication control circuit, the transmission sequence included in the transmission sequence setting command including the address which agrees with its address, as its transmission sequence.

Further, according to another modified example, the information acquirement request command may include a device address as a bit stream indicating an address of one of a plurality of drive control devices connected with the performance CPU 2. In this case, only the drive control device designated by the device address may create a response signal and output the response signal to the performance CPU 2. Alternatively, only the drive control device having an address with a larger value than that of the drive control device designated by the device address may create a response signal and output the response signal to the performance CPU 2. In this case, the transmission start timing may, for example, be decided by Expression (2):

$$T(A)=D+(A-A0)*(M+G) \qquad \text{Expression (2)}$$

However, A0 is the device address included in the information acquirement request command, and when the maximum value of the address is (n−1), it has a value of 0 to (n−1). Then, the drive control device with T(A) being negative does not transmit the response signal.

Also in this case, when the device address is not designated or it includes a value indicating invalidity, as the above embodiment, each drive control device may only create the response signal and decide the transmission start timing for the response signal according to Expression (1).

According to this modified example, the performance CPU 2 can both find information from all the drive control devices and find information only from a specific drive control device, thus increasing the degree of freedom in control.

According to still another modified example, the information acquirement request command may include trigger information indicating a time for the start of transmission. For example, the trigger information may be a bit stream indicating a clock number from the time point when reception of the information acquirement request command is completed until the drive control device which first transmits the response signal actually starts transmission of the response signal. In this modified example, signal line 4-4, which is used for transmission of the enable signal, may be omitted.

The drive control device according to the above embodiment or modified example may be installed in a game machine such as a pinball game machine or a reel game machine.

Figure 8:
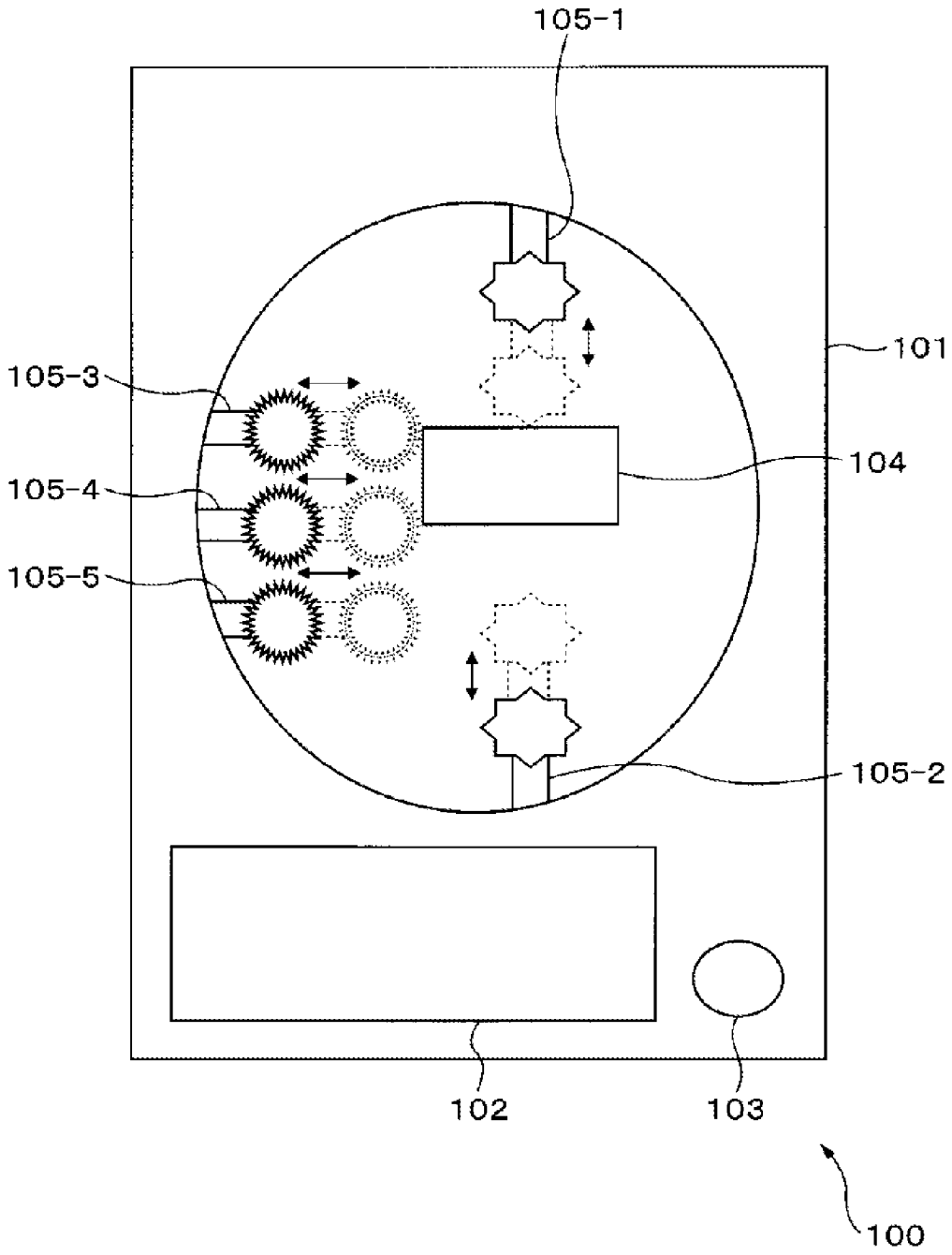
FIG. 8 is a schematic front view of a pinball game machine provided with a plurality of drive control devices according to an embodiment or a modified example.
Figure 9:
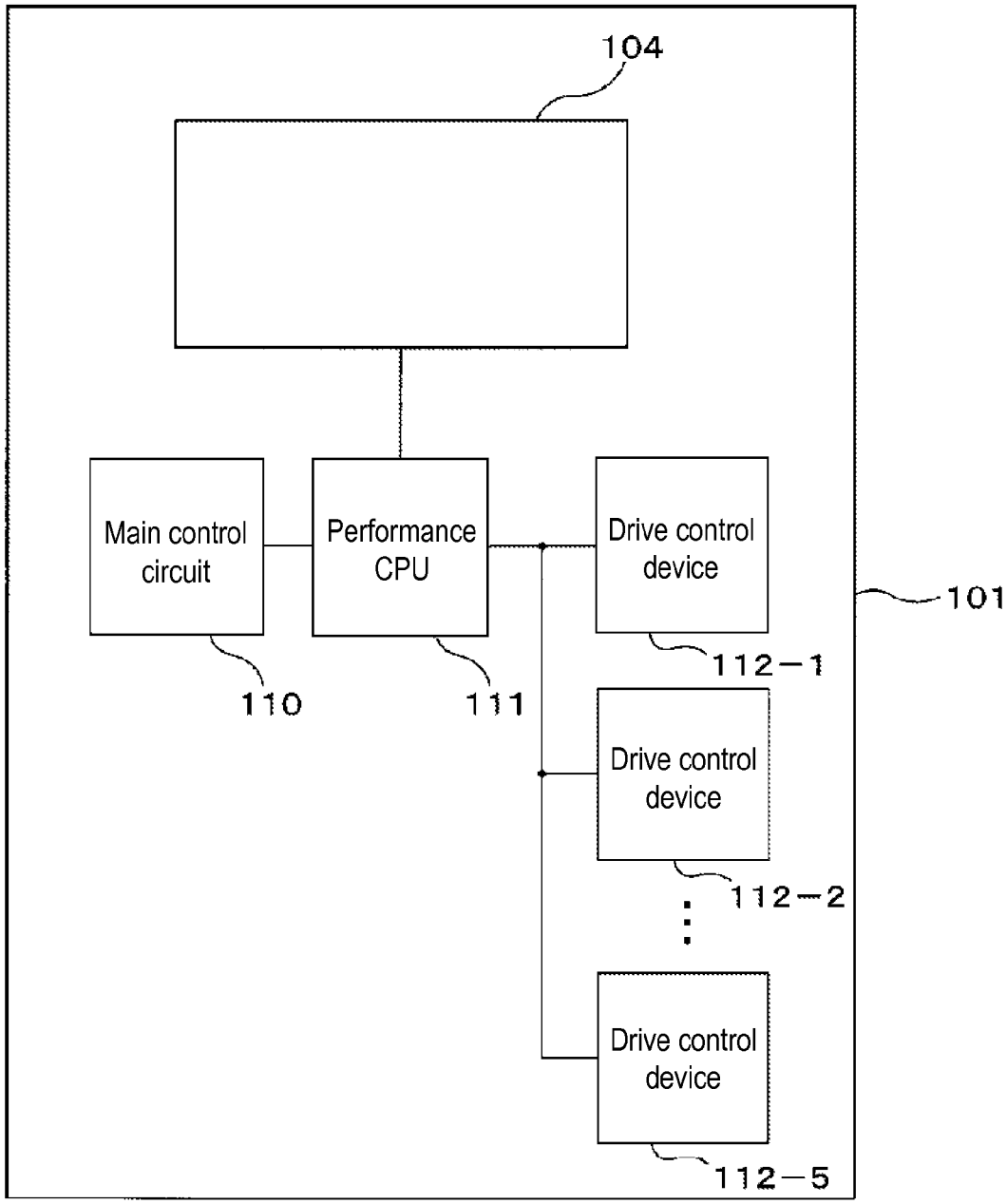
FIG. 9 is a schematic rear view of the pinball game machine shown in FIG. 8.

FIG. 8 is a schematic front view of a pinball game machine 100 provided with a plurality of drive control devices according to the above embodiment or modified example. Further, FIG. 9 is a schematic rear view of the pinball game machine 100. As shown in FIG. 8, the pinball game machine 100 has: a game board 101 as a game machine body, provided in most of a region from the top to the center; a ball receiving portion 102 arranged below the game board 101; operation unit 103 provided with a handle; and the display device 104 provided at the substantially center of the game board 101.

Further, the pinball game machine 100 has five movable accessory portions 105-1 to 105-5 arranged on the front surface of the game board 101 for performance of a game. Further, a rail (not shown) is disposed on the side of the game board 101. Moreover, a large number of obstacle nails (not shown) and at least one winning device (not shown) are provided on the game board 101.

The operation unit 103 launches a game ball by predetermined force from a launch device (not shown) in accordance with a revolving amount of the handle operated by the player. The launched game ball moves upward along the rail, and is dropped among the large number of obstacle nails. When entry of the game ball into any of the winning devices is detected by a sensor, not shown, the main control circuit 110 provided on the rear surface of the game board 101 puts out a predetermined number of game balls in accordance with the winning devices where the game balls have entered, to the ball receiving portion 102 via a ball put-out device (not shown). Moreover, the main control circuit 110 displays a variety of images in the display device 104 via the performance CPU 111 provided on the rear surface of the game board 101.

Each of movable accessory portions 105-1 to 105-5 is one example of the movable bodies that move in accordance with a state of a game. They are driven by a drive device (not shown) which are provided on the rear surface of the game board 101 and controlled by the drive control devices 112-1 to 112-5 according to an embodiment or the modified example thereof.

Based on a state signal indicating the state of the game and transmitted from the main control circuit 110 to the performance CPU 111, the performance CPU 111 determines target coordinates of each of the movable accessory portions 105-1 to 105-5, and creates a drive command according to that decision. The performance CPU 111 then outputs the generated drive command to each of the drive control devices 112-1 to 112-5. Further, after a lapse of a predetermined period from transmission of the drive command, the performance CPU 111 creates a common information acquirement request command with respect to each of drive control devices 112-1 to 112-5, and transmits the information acquirement request command. Upon receiving the information acquirement request command, each of the drive control devices 112-1 to 112-5 creates a response signal and determines transmission start timing for the response signal based on its address. When an enable signal from the performance CPU 111 to each of drive control devices 112-1 to 112-5 is turned on, each of drive control devices 112-1 to 112-5 sequentially transmits the response signal to performance CPU 111.

In this drive control system, it is preferable that, when the information acquirement request signal includes an address that specifies any of the plurality of drive control devices, only a drive control device corresponding to the address transmit the response signal to the upper-level control device. It is preferable on the other hand that, when the information acquirement request signal does not include the address, each of the plurality of drive control devices transmit the response signal to the upper-level control device in accordance with its transmission start timing.

Further, there may be provided a drive control device which is connected in parallel with another drive control device via a common signal line to an upper-level control device and controls a drive device for driving a movable body provided in a game machine. This drive control device is characterized by having a communication interface circuit and a communication control circuit. The communication interface circuit transmits and receives a signal to and from the upper-level control device via the signal line. The communication control circuit creates a response signal including predetermined information upon reception of an information acquirement request signal from the upper-level control device, decides transmission start timing for the response signal based on transmission sequence information indicating its transmission sequence and a length of the response signal such that the response signal does not temporally overlap with another response signal being transmitted from another drive control device to the upper-level control device via the signal line, and starts transmission of the response signal via the communication interface circuit at its transmission start timing.

In this drive control device, it is preferable that the communication control circuit start time counting from a reference time designated by a trigger signal received from the upper-level control device, and the communication control circuit start transmission of the response signal via the communication interface circuit at the transmission start timing.

Further, in the drive control device, it is preferable that the information acquirement request signal include response signal length information indicating a length of the response signal, and the communication control circuit decide the length of the response signal based on the response signal length information, and decide the transmission start timing in accordance with the decided length of the response signal.

Moreover, in the drive control device, it is preferable that an interval between the response signal transmitted from the drive control device and another response signal transmitted from another drive control device be shorter than the information acquirement request signal.

According to an embodiment, a drive control device and a drive control system has the effect of being able to reduce a cycle for transmitting information to an upper-level control device even when a plurality of drive control devices are connected in parallel with each other to the upper-level control device.

In such a manner, the skilled person in the art can make a variety of changes in accordance with an embodiment within the scope of the present invention.

What is claimed is:

1. A drive control system comprising:

a plurality of drive control devices configured to individually control a plurality of drive devices for driving a movable body provided in a game machine; and an upper-level control device to which the plurality of drive control devices are connected in parallel with each other via a common signal line, wherein, the upper-level control device is configured to transmit a common information acquirement request signal to each of the plurality of drive control devices, and each of the plurality of drive control devices is configured to:

receive the common information acquirement request signal, wherein the common information acquirement request signal includes response signal length information indicating a length of the response signal;

determine a transmission start timing for a response signal based on its transmission sequence information indicating its transmission sequence and a length of the response signal such that the response signal does not temporally overlap with a response signal to be transmitted from another one of the plurality of the drive control devices to the upper-level control device;

determine the length of the response signal based on the response signal length information, and determine the transmission start timing in accordance with the decided length of the response signal; and transmit the response signal to the upper-level control device via the signal line at its transmission start timing upon receiving a trigger signal from the upper-level control device.

2. A game machine comprising:

a movable body;

a drive device configured for driving the movable body; and a drive control system according to claim 1 for controlling the drive device.

3. The drive control system according to claim 1, wherein, when the common information acquirement request signal includes an address that specifies any of the plurality of drive control devices, only one of the plurality of drive control devices having an address corresponding to the address transmits the response signal to the upper-level control device, whereas, when the common information acquirement request signal does not include the address, each of the plurality of drive control devices transmits the response signal to the upper-level control device in accordance with its transmission start timing.

4. A game machine comprising:

a movable body;

a drive device configured for driving the movable body; and a drive control system according to claim 3 for controlling the drive device.

5. A drive control device connected in parallel with another drive control device via a common signal line to an upper-level control device, the drive control device configured to control a drive device for driving a movable body provided in a game machine, the drive control device comprising:

a communication interface circuit configured to transmit and receive a signal to and from the upper-level control device via the signal line; and a communication control circuit configured to create a response signal upon receiving an information acquirement request signal from the upper-level control device, determine a transmission start timing for the response signal based on transmission sequence information indicating its transmission sequence and a length of the response signal such that the response signal does not temporally overlap with another response signal being transmitted from another drive control device to the upper-level control device via the signal line, and transmit the response signal to the upper-level control device via the communication interface circuit at its transmission start timing upon receiving a trigger signal from the upper-level control device, wherein the information acquirement request signal includes response signal length information indicating a length of the response signal, and the communication control circuit is configured to determine the length of the response signal based on the response, signal length information, and determine the transmission start timing in accordance with the decided length of the response signal.

6. The drive control device according to claim 5, wherein the communication control circuit is configured to start time counting from a reference time designated by the trigger signal received from the upper-level control device, and the communication control circuit starts transmission of the response signal at the transmission start timing via the communication interface circuit.

7. The drive control device according to claim 6, wherein an interval between the response signal transmitted from the drive control device and the another response signal transmitted from the another drive control device is shorter than the information acquirement request signal.

8. The drive control device according to claim 5, wherein an interval between the response signal transmitted from the drive control device and the another response signal transmitted from the another drive control device is shorter than the information acquirement request signal.

* * * * *